US008240806B2

(12) United States Patent
Fosas et al.

(10) Patent No.: US 8,240,806 B2
(45) Date of Patent: Aug. 14, 2012

(54) PRINTHEAD FIRING

(75) Inventors: David Soriano Fosas, Terrassa (ES); Felix Ruiz Martinez, Sant Cugat del Valles (ES); Ismael Chanclon Fernandez, Cornella de Llobregat (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 285 days.

(21) Appl. No.: 12/789,974

(22) Filed: May 28, 2010

(65) Prior Publication Data

US 2011/0292109 A1 Dec. 1, 2011

(51) Int. Cl.
*B41J 29/38* (2006.01)
*B41J 29/393* (2006.01)

(52) U.S. Cl. ..... 347/19; 347/5; 347/11

(58) Field of Classification Search ..... 347/5, 11, 347/19

See application file for complete search history.

(56) References Cited

U.S. PATENT DOCUMENTS

| | | | | |
|---|---|---|---|---|
| 6,302,514 | B1 | 10/2001 | Eade et al. | |
| 6,413,702 | B1 | 7/2002 | Hercher | |
| 7,405,393 | B2 | 7/2008 | Martenson et al. | |
| 7,439,488 | B2 * | 10/2008 | Chen | 250/231.13 |
| 2006/0181570 | A1 * | 8/2006 | Grosse et al. | 347/37 |

FOREIGN PATENT DOCUMENTS

JP 2009281990 A2 3/2009

* cited by examiner

*Primary Examiner* — Jason Uhlenhake

(57) ABSTRACT

Printhead firing methods, apparatus and articles of manufacture are disclosed. An example printhead firing method disclosed herein comprises determining a position of a printer carriage corresponding to a location at which a first encoder strip is concatenated with a second encoder strip, and adjusting timing of printhead firing pulses when the printer carriage is determined to have reached the position as the printer carriage is moved.

20 Claims, 7 Drawing Sheets

PRINTHEAD FIRING

BACKGROUND

Conventional inkjet and piezo based printers typically use carriage position encoders implemented by linear optical encoders to determine printer carriage position. A carriage position encoder reads an encoder strip having vertical lines (or any other type of marker) and generates an output containing a sequence of pulses corresponding to the lines (or other markers) that have been read. These pulses are counted to determine carriage position. The sequence of pulses output by the carriage position encoder is also used to synchronize a sequence of printhead firing pulses driving the printheads in the printer carriage.

DETAILED DESCRIPTION

Figure 1:
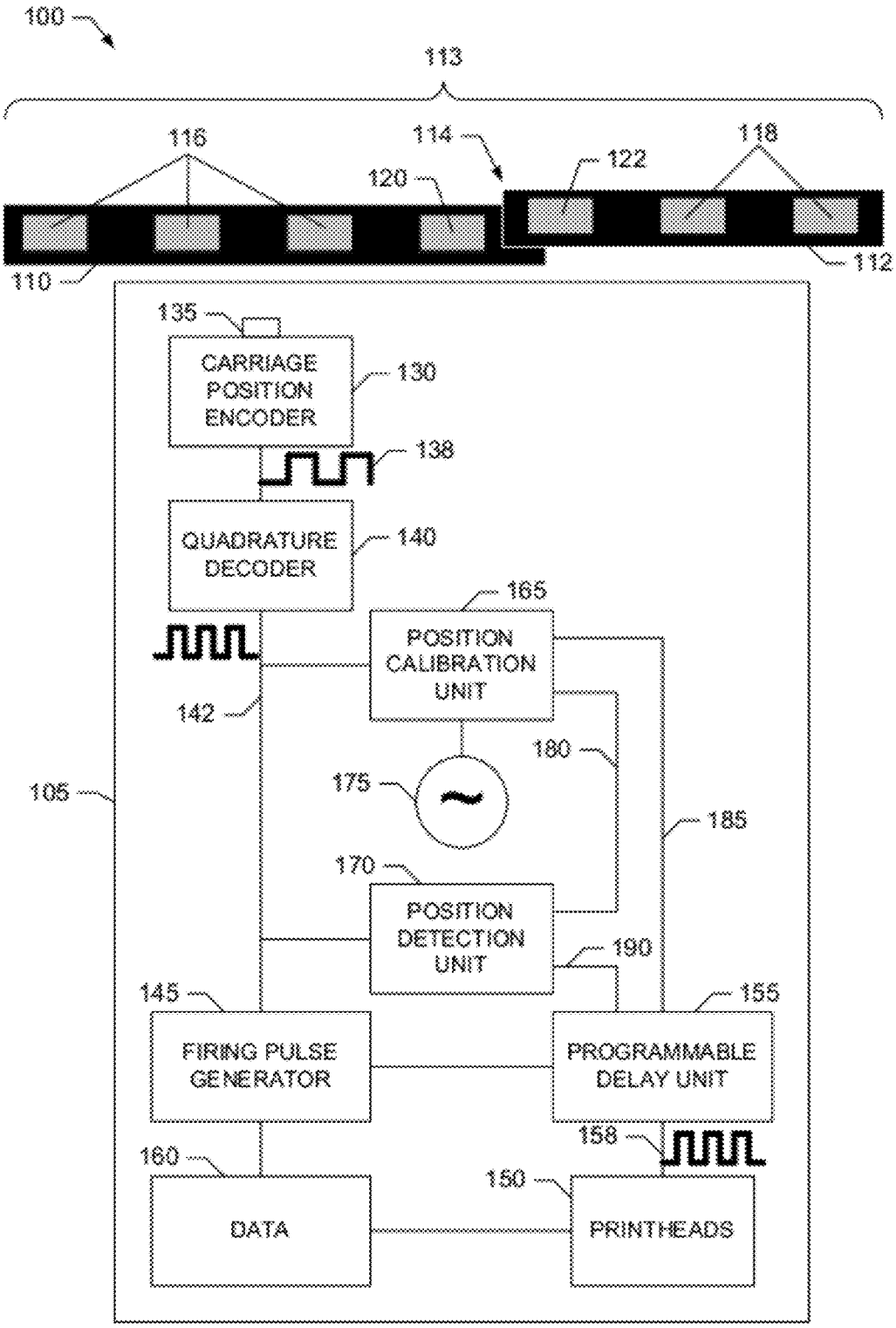
FIG. 1 is block diagram of an example environment of use including an example printer carriage capable of reducing printhead firing error caused by concatenating multiple encoder strips.

Methods, apparatus and articles of manufacture to reduce printhead firing error caused by concatenating multiple encoder strips are disclosed herein. A disclosed example printhead firing method includes determining a position of a printer carriage corresponding to a location at which a first encoder strip is concatenated with a second encoder strip. For example, the position can be determined by moving the printer carriage at a known speed along the concatenated first and second encoder strips; counting pulses in a signal corresponding to an output of a carriage position encoder (e.g., such as a signal that is an interpolated version of the output of the carriage position encoder) produced when the carriage position encoder reads markers (e.g., such as vertical lines) included in the concatenated first and second encoder strips as the printer carriage moves at the known speed; detecting a first pulse period in the signal that deviates outside an allowed range of pulse periods defined by an upper limit and a lower limit; and using a number of pulses having been counted upon detection of the first pulse period to represent the position at which the deviation occurs. After the position of deviation is determined, timing of the printhead firing pulses is then adjusted during subsequent printer operation(s) when the printer carriage is determined to have reached the position of deviation as the printer carriage is moved along the concatenated first and second encoder strips. For example, the timing of the printhead firing pulses can be adjusted by applying a same timing adjustment (e.g., such as a constant timing delay or a constant time advance) to each firing pulse triggered when and/or after the printer carriage is determined to have moved to or beyond the position of deviation.

As used herein, the term "location" is meant refer to a point, area, region, position, etc., in space, time, etc., corresponding to a feature, object, behavior, characteristic, etc., of interest.

The example methods, apparatus and articles of manufacture described herein can provide significant benefits and advantages over prior techniques to reduce printhead firing error caused by concatenating multiple encoder strips. Larger printers can require concatenation (e.g., adjacent positioning and fixing via, for example, gluing) of two or more encoder strips to form a longer encoder strip capable of extending across the larger printing area. Concatenating two (or more) encoder strips to form a longer encoder strip can result in discontinuity region(s) where the spacing between adjacent encoder strip markers deviates from an expected spacing. This deviation of adjacent marker spacing in a discontinuity region can cause timing errors in the printhead firing pulses triggered in and beyond the discontinuity region. Prior techniques to reduce such printhead firing error attempt to smooth the timing error in the discontinuity region where the two encoder strips are joined. However, these prior techniques typically reduce the timing error of the printhead firing pulses only for a set of firing pulses triggered near the discontinuity region, while leaving a residual timing error in the firing pulses triggered after the printhead has moved beyond the discontinuity. Unlike such prior techniques, the example methods, apparatus and articles of manufacture described herein determine (e.g., through calibration) the particular timing error caused by the deviation of adjacent marker spacing in the discontinuity region where two encoder strips are joined. The example methods, apparatus and articles of manufacture described herein then apply a timing adjustment based on the determined timing error to the timing of each firing pulse triggered in and beyond the discontinuity region, rather than just attempting to smooth the error for a relatively few pulses triggered near the discontinuity region. As a result, the example methods, apparatus and articles of manufacture described herein can reduce, if not substantially eliminate, any residual timing error in the printhead firing pulses caused by encoder strip concatenation.

FIG. 1 illustrates a block diagram of an example environment of use 100 including an example printer carriage 105 capable of reducing printhead firing error caused by concatenating multiple encoder strips 110, 112 according to the methods, apparatus and/or articles of manufacture described herein. The environment of use 100 includes two example encoder strips 110, 112 that are positioned adjacent to each other (with possible overlapping) and joined using any type of mechanical and/or chemical fixing technique, such as gluing, screwing, riveting, fastening, etc., at a discontinuity location 114 to form a longer, concatenated encoder strips 113. Each encoder strip 110, 112 includes a respective plurality of example markers 116, 118, which can be vertical lines or any other shape (e.g., such as the rectangular shape depicted in FIG. 1). The example markers 116, 118 may be formed in any desired manner (e.g., such as stripes, attached reflectors, color changes, etc.). In the illustrated example, a last marker 120 of the first encoder strip 110 is adjacent to a first marker 122 of the second encoder strip 112. The last marker 120 of the first encoder strip 110 and the first marker 122 of the second encoder strip 112 are also positioned on opposite sides of the discontinuity location 114 where the first and encoder strips 110, 112 are joined. As shown in FIG. 1, there is equal (or at least substantially equal) spacing between adjacent markers 116 of the first encoder strip 110 and between adjacent markers 118 of the second encoder strip 112. However, the spacing between the last marker 120 of the first encoder strip 110 and the first marker 122 of the second encoder strip 112 positioned on either side of the discontinuity location 114 can, and often will, deviate from the expected spacing between the markers 116, 118 on each of the respective encoder strips 110, 112.

The printer carriage 105 of the illustrated example can be used to implement, for example, an inkjet printer, a piezo based printer, etc. The printer carriage 105 of the illustrated example includes a carriage position encoder 130 to determine printer carriage position. In the illustrated example, the carriage position encoder 130 is implemented by a linear optical encoder and, thus, includes an example optical sensor 135 to read the markers 116-122 included in (or, equivalently, on) the concatenated encoder strips 113. The carriage position encoder 130 produces an example output 138 containing pulses corresponding to the markers read using the optical sensor 135 as the printer carriage 105 is moved along the concatenated encoder strips 113. For example, a pulse can be included by the carriage position encoder 130 in the output 138 each time one of the markers 116-122 is read. In some examples, the spacing of the markers 116-122 and the speed of the printer carriage 105 are configured to provide pulses in the output 138 corresponding to a desired printer resolution (e.g., such as, but not limited to, 150 dots per inch (dpi)).

To provide higher print resolutions, the print carriage 105 includes an example quadrature decoder 140. The quadrature decoder 140 interpolates the output 138 of the carriage position encoder 130 to generate an example interpolated signal 142 corresponding to the output 138 of the carriage position encoder 130 but including pulses interpolated between the pulses of the output 138. The quadrature decoder 140 can be thought of as a multiplier that functions to produce a signal corresponding to the output 138, but having a greater number of pulses. Any type of interpolation technique and/or other signal processing can be employed by the quadrature decoder 140. In some examples, the quadrature decoder 140 interpolates by one or more factors, such as a factor of 2, a factor of 4, a factor of 8, etc., to produce pulses in the interpolated signal 142 corresponding to desired higher printer resolutions (e.g., such as, but not limited to, 300 dpi, 600 dpi, 1200 dpi, etc.).

The pulses in the interpolated signal 142 corresponding to the output 138 of the carriage position encoder 130 are used to synchronize firing of the printhead nozzles included in the example printheads 150 of the printer carriage 105. For example, the printer carriage 150 may include three (3) printheads 150 corresponding to three different colors, with each printhead 150 having a heater or piezoelectric element controlled by a respective firing pulse signal which, when triggered (or, in other words, fired), causes a droplet of ink to be released from the printhead's nozzle. Accordingly, the printer carriage 105 includes an example firing pulse generator 145 to generate the firing pulses for the printheads 150 based on the interpolated signal 142 output by the quadrature decoder 140. The output of the firing pulse generator 145 is delayed by a programmable delay unit 155 to allow the timing of the firing pulse signals 158 feeding the printheads 150 to be adjusted as needed. Of course, the firing pulse generator 145 and/or the printheads 150 are also controlled to release ink droplets needed to produce a desired print image in accordance with data 160 reflecting that image. This aspect of controlling printing is beyond the scope of this disclosure and will not be further discussed herein.

As shown in the example of FIG. 1, concatenating the two encoder strips 110, 112 to form the longer encoder strip 113 results in a discontinuity region in the discontinuity location 114 within which the spacing between the adjacent markers 120-122 deviates from the expected spacing existing between the other markers 116, 118. As noted above, this deviation of adjacent marker spacing in the discontinuity region can cause timing errors in the printhead firing pulses triggered in and beyond the discontinuity region. To reduce such timing error caused by concatenating the two encoder strips 110, 112 to form the longer encoder strip 113, the printer carriage 105 includes an example position calibration unit 165 and an example position detection unit 170. The position calibration unit 165 is driven by an example high-speed clock source 175, which may be implemented using any appropriate clock source, such as a temperature controlled oscillator (TCXO), a voltage controlled oscillator (VCO), a timer, etc. The position calibration unit 165 of the illustrated example determines a position of a printer carriage 105 corresponding to the discontinuity location 114 at which the first encoder strip 110 is concatenated with the second encoder strip 112. In other words, the position calibration unit 165 determines a position of the printer carriage 105 corresponding to a location at which a spacing between adjacent markers (e.g., such as the spacing between the adjacent markers 120-122) included in the concatenated first and second encoder strips 113 deviates from an expected spacing between adjacent markers.

For example, to determine this particular position of the printer carriage 105, the position calibration unit 165 performs a calibration procedure during which the printer carriage 105 is moved along the concatenated encoder strips 113 at a known speed (e.g., such as, but not limited to, 20 inches per second (ips)). While the printer carriage 105 is moving at this known speed, the position calibration unit 165 determines the pulse period between adjacent pulses in the interpolated signal 142 of the quadrature decoder 140 by, for example, counting pulses of the high speed clock 175 that occur between successive pulses of the interpolated signal 142. As described above, the pulses in the interpolated signal 142 correspond to (e.g., are an interpolated version of) the pulses in the output 138 generated by the carriage position encoder 130 through reading of the markers 116-122 of the concatenated encoder strips 113. To determine the position of the printer carriage 105 corresponding to the location where the encoder strips 113 are joined or, in other words, where a deviation in adjacent marker spacing occurs, the position calibration unit 165 detects a particular pulse period that deviates outside an allowed range of pulse periods defined by an upper limit and a lower limit. As described in greater detail below, this allowed range of pulse periods bounds an expected pulse period between adjacent pulses, with an allowed uncertainty specified by the upper and lower limits. When the position calibration unit 165 detects a particular pulse period in the interpolated signal 142 that deviates outside the allowed range of pulse periods, the position calibration unit 165 asserts a latch signal 180 to cause the position detection unit 170 to latch the position corresponding to this particular pulse period and, as such, the position of the printer carriage 105 corresponding to the location where the encoder strips 110, 112 are joined (i.e., where a deviation in adjacent marker spacing occurs). This position may be recorded as, for example, a pulse count corresponding to a number of marker pulses counted beginning at a first (e.g., starting) end of the concatenated encoder strips 113 until the latch signal 180 is asserted. Additionally, the position calibration unit 165 determines a timing adjustment based on the difference between the detected pulse period and the expected pulse period. The position calibration unit 165 outputs a timing adjustment signal 185 representative of the determined timing adjustment. The timing adjustment is then stored in the programmable delay unit 155 to allow the timing adjustment to be applied to each firing pulse occurring when the printer carriage 105 reaches the latched position and as the printer carriage 105 is moved beyond the latched position. As described in greater detail below, by determining and applying this timing adjustment to each firing pulse triggered when the printer carriage 105 reaches (e.g., moves to or beyond) the latched position, the firing pulse timing error caused by concatenating the encoder strips 110, 112 can be reduced systematically over the firing pulses triggered at and after the discontinuity location 114 without leaving residual timing error.

The position detection unit 170 is included in the printer carriage 105 to determine the position of the printer carriage 105. The position detection unit 170 also detects when the printer carriage 105 reaches (e.g., moves to or beyond) the particular position of the printer carriage 105 corresponding to the location where the encoder strips 110, 112 are concatenated or, in other words, where a deviation in adjacent marker spacing occurs. For example, and as described in greater detail below, the position detection unit 170 can count the number of pulses in the interpolated signal 142 output by the quadrature decoder 140 as the printer carriage 105 is moved along the concatenated encoder strips 113 (from the beginning of the strip 113 or later, as long as the starting position is known) and use the counted number of pulses to represent the printer carriage's position. When the accumulated count of pulses meets or exceeds a number of pulses used to represent the position determined by the position calibration unit 165 (e.g., caused to be latched) as the position of deviation, the position detection unit 170 outputs a timing adjustment trigger signal 190. This signal 190 causes the programmable delay unit 155 to thereafter apply the timing adjustment programmed by the position calibration unit 165 to the firing pulse signals 158 feeding the printheads 150 to thereby reduce or eliminate timing errors otherwise caused by concatenating the encoder strips 110, 112.

Figure 2:
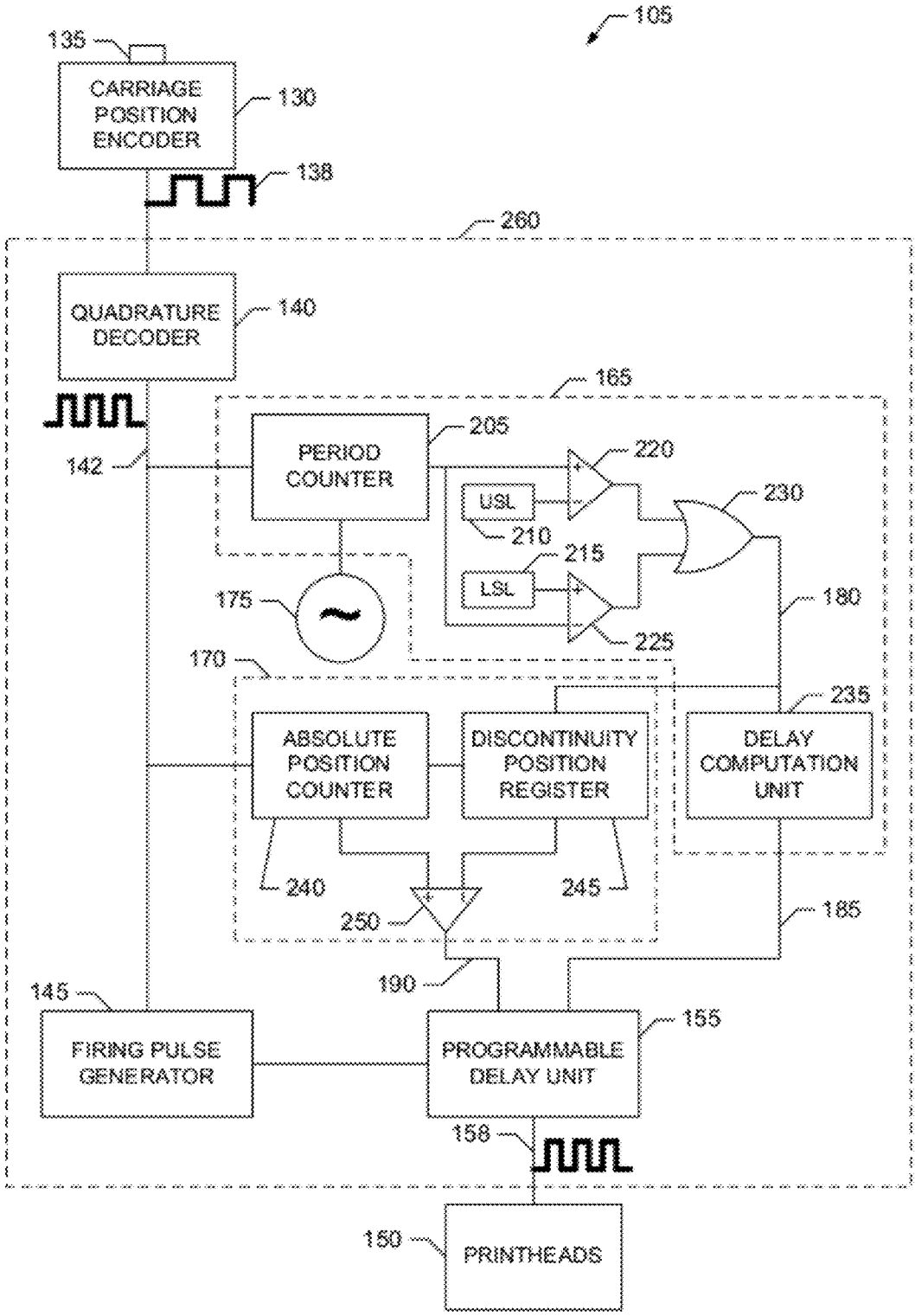
FIG. 2 is a block diagram of an example implementation of the printer carriage of FIG. 1.
Figure 3:
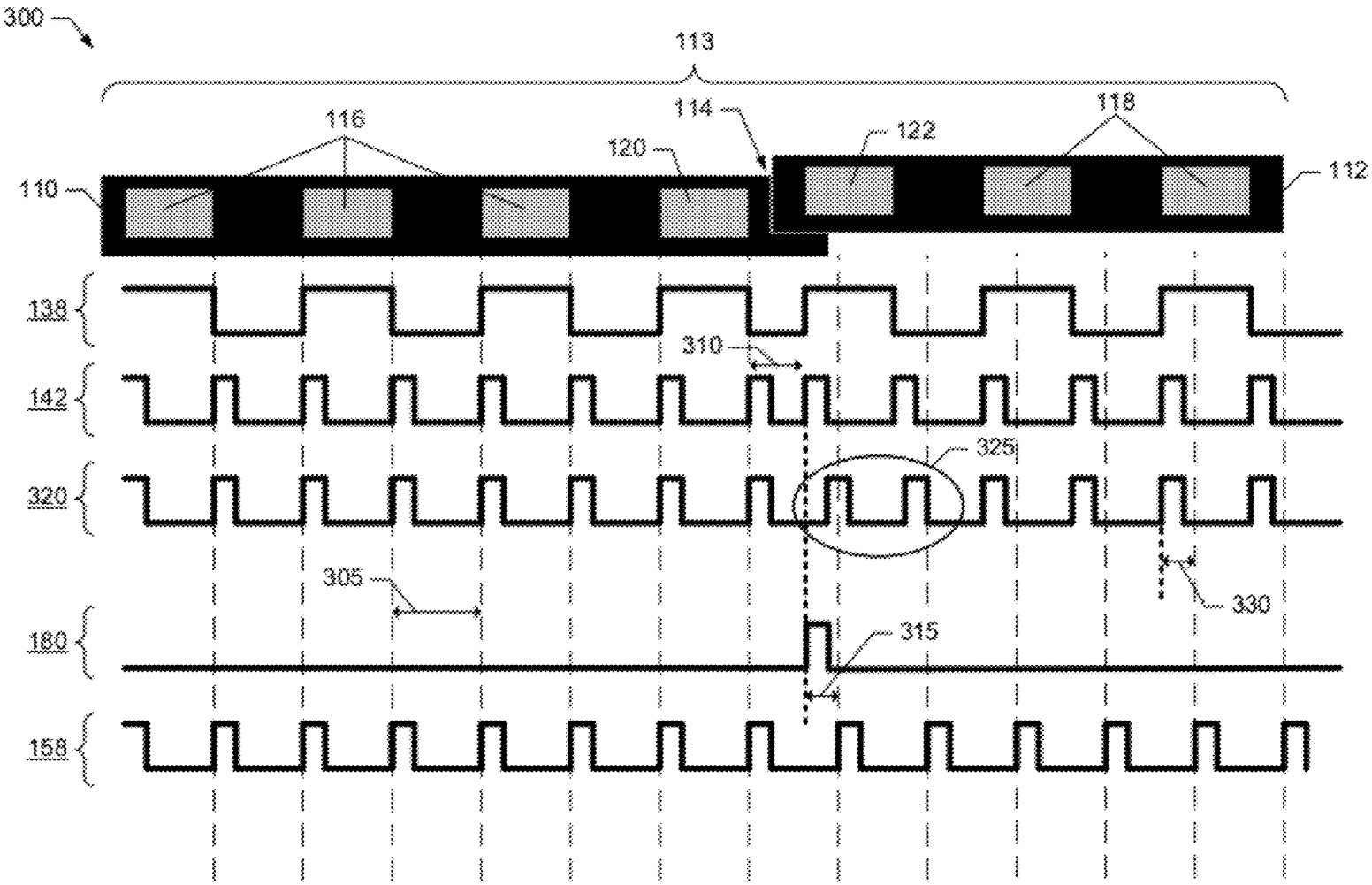
FIG. 3 is a signal diagram illustrating an example operation of the printer carriage of FIG. 2.

A block diagram an example implementation of the printer carriage 105 depicting an example implementation of the position calibration unit 165 and the position detection unit 170 is illustrated in FIG. 2. Operation of the printer carriage 105 of FIG. 2 is described in conjunction with the example signal diagrams 300 illustrated in FIG. 3. FIGS. 2 and 3 include many elements in common with FIG. 1. As such, like elements in FIGS. 1, 2 and 3 are labeled with the same reference numerals. The detailed descriptions of these like elements are provided above in connection with the discussion of FIG. 1 and, in the interest of brevity, are not repeated in the discussion of FIGS. 2 and 3.

Turning to FIG. 2, and with reference to FIG. 3, the position calibration unit 165 includes an example period counter 205 driven by the high speed clock 175. The period counter 205 can be implemented using any type of counter. In the illustrated example, the period counter 205 counts the number of clock pulses of the high speed clock 175 occurring between successive pulses detected in the interpolated signal 142 output by the quadrature decoder 140. The output of the period counter 205 is latched each time a pulse is detected in the interpolated signal 142, and the period counter 205 then restarts counting at zero. Thus, during calibration when the printer carriage 105 is moved along the concatenated encoder strips 113 at the known speed, the output of the period counter 205 represents the pulse period (measured in numbers of clock ticks of the high speed clock 175) between adjacent pulses of the interpolated signal 142. As described above, this pulse period between adjacent pulses of the interpolated signal 142 corresponds to (e.g., is proportional to) the spacing between respective adjacent markers of the concatenated encoder strips 113 as read by the carriage position encoder 130.

To determine the position of the printer carriage 105 corresponding to the location where the encoder strips 110, 112 are concatenated (and where a deviation in adjacent marker spacing occurs), the output of the period counter 205 is processed to detect a pulse period that deviates outside an allowed range of pulse periods defined by an upper limit and a lower limit. In the illustrated example, the allowed range of pulse periods is specified by an upper limit stored in an example upper specification limit register 210 and a lower limit stored in an example lower specification limit register 215. Either or both of the upper and lower specification limit registers 210 and 215 may be fixed or programmable (e.g., and, thus, adjustable). The position calibration unit 165 also includes example comparators 220 and 225 to compare the upper and lower limits stored in the respective upper and lower specification limit registers 210 and 215 to the output of the period counter 205. In the illustrated example, the outputs of the comparators 220 and 225 are coupled to respective inputs of an example OR gate 230 to produce the latch signal 180. In the illustrated example, the latch signal 180 is asserted during the calibration procedure when the output of either of the comparators 220 or 225 is asserted. The output of the comparator 220 is asserted when the output of the period counter 205 is greater than or equals the upper limit stored in the upper specification limit register 210. The output of the comparator 225 is asserted when the output of the period counter 205 is less than or equals the lower limit stored in the lower specification limit register 225. Thus, the latch signal 180 is asserted when a particular pulse period deviating outside the allowed range of pulse periods has been detected.

The position calibration unit 165 of FIG. 2 also includes an example delay computation unit 235 to determine a timing adjustment to compensate for the particular timing error caused by a deviation of adjacent marker spacing in the discontinuity region of the concatenated encoder strips 113. This deviation of adjacent marker spacing causes a pulse period in the interpolated signal 142 to deviate outside the allowed range of pulse periods, resulting in assertion of the latch signal 180. As such, during the calibration procedure, the delay computation unit 235 detects when the latch signal 180 is asserted, which indicates that the current pulse period represented by the output of the period counter 205 deviates outside the allowed range of pulse periods. When the delay computation unit 235 detects that the latch signal 180 is asserted, the delay computation unit 235 determines the difference between the current pulse period output by the period counter 205 and an expected pulse period between adjacent pulses of the interpolated signal 142. For example, the expected pulse period can be determined from: (1) the known equal (or substantially equal) spacing (D) between adjacent markers 116 of the first encoder strip 110 and/or the known spacing (D) between adjacent markers 118 of the second encoder strip 112; (2) the known speed (V) at which the printer carriage 105 is moved along the concatenated encoder strips 113 during the calibration procedure; and (3) the known clock period (T) of the high speed clock source 175, using the equation E=D/(R T), where E represents the number of clock pulses of the high speed clock source 175 occurring in the expected pulse period. If the current (e.g., deviated) pulse period is less than the expected pulse period, the timing adjustment determined by the delay computation unit 235 is a timing delay corresponding to the difference between the current (e.g., deviated) pulse period and the expected pulse period. Conversely, if the current (e.g., deviated) pulse period is greater than the expected pulse period, the timing adjustment determined by the determined delay computation unit 235 is a timing advance corresponding to the difference between the current (e.g., deviated) pulse period and the expected pulse period.

Operation of the position calibration unit 165 of FIG. 2 is further illustrated by the signal diagrams 300 of FIG. 3. FIG. 3 illustrates an example output 138 of the carriage position encoder 130 as the printer carriage 105 is moved along the concatenated encoder strips 113 at a known speed. The output 138 includes pulses corresponding to the markers 116-122 read by the carriage position encoder 130. FIG. 3 also illustrates an example interpolated signal 142 output by the quadrature decoder 140 that corresponds to the output 138 interpolated by a factor of 2. For example, if the pulses in the output 138 of FIG. 3 correspond to a printer resolution of 150 dpi, then the pulses in the interpolated signal 142 correspond to a printer resolution of 300 dpi.

As shown in the example signals 300 of FIG. 3, the interpolated signal 142 exhibits an expected pulse period 305 corresponding to the expected spacing between the adjacent pulses 116, 118. Generally, the expected pulse period 305 of the interpolated signal 142 is proportional to the expected adjacent marker spacing, with the proportional factor related to the interpolation factor. Additionally, the interpolated signal 142 includes a particular pulse period 310 corresponding to the adjacent markers 120-122 that deviates from the expected pulse period 305. As shown in the example signals 300 of FIG. 3, this pulse period deviation results in assertion of the latch signal 180, thereby indicating that the particular pulse period 310 deviates from the expected pulse period 305 and corresponds to a deviation of adjacent marker spacing in the discontinuity region 114 of the concatenated encoder strips 113.

FIG. 3 also illustrates an example timing adjustment 315 determined by the delay computation unit 235. As shown in FIG. 3, the timing adjustment 315 is determined to be the difference between the deviated pulse period 310 and the expected pulse period 305. Here, the deviated pulse period 310 is less than the expected pulse period 305 and, thus, the determined timing adjustment 315 corresponds to a timing delay.

Returning to FIG. 2, the position detection unit 170 includes an absolute position counter 240 to count pulses in the interpolated signal 142. Because the pulses in the interpolated signal 142 correspond to markers in the concatenated encoder strips 113, the position of the printer carriage 105 can be tracked by appropriately counting the occurrence of these pulses. For example, beginning from a starting position and upon detection of a pulse in the interpolated signal 142, the absolute position counter 240 increments or decrements its absolute position count based on the direction of motion of the printer carriage 105 along the concatenated encoder strips 113. As such, the current output of the absolute position counter 240 is a number of pulses that is proportional (based on the interpolation factor and printer carriage speed) to the position of the printer carriage 105 along the concatenated encoder strips 113. Thus, the output of the absolute position counter 240 can be used to represent the absolute position of the printer carriage 105 as it moves along the concatenated encoder strips 113.

The position detection unit 170 also includes a discontinuity position register 245 to store (e.g., latch) the output of the absolute position counter 240 when the latch signal 180 is asserted. In the illustrated example, the discontinuity position register 245 is used to store a position of the printer carriage 105 (e.g., represented as a number of pulses counted by the absolute position counter 240) corresponding to the location 114 where the encoder strips 110, 112 are concatenated or, in other words, where the deviation in adjacent marker spacing occurs. As described above, this particular position of the printer carriage 105, which is also referred to as the discontinuity position 114 of the printer carriage 105, is determined using the calibration procedure performed by the position calibration unit 165 and corresponds to occurrence of a pulse period in the interpolated signal 142 that deviates outside an allowed range of pulse periods. To determine this discontinuity position, the absolute position counter 240 counts the pulses in the interpolated signal as the printer carriage 105 moves along the concatenated encoder strips 113 during the calibration procedure. Then, when the latch signal 180 is asserted by the position calibration unit 165 (e.g., due to detection of the deviated pulse period), the discontinuity position register 245 stores (e.g., latches) the output of the absolute position counter 240. This latched value is used to represent the discontinuity position.

In some examples, the position calibration unit 165 is disabled after calibration completes (although the position calibration unit 165 may be re-enabled to perform recalibration, as described in greater detail below). Then, during subsequent (e.g., normal) operation of the printer carriage 105, the position detection unit 170 compares the output of the absolute position counter 240 to the value stored in the discontinuity position register 245 using a location comparator 250 to determine whether the printer carriage 105 has reached (e.g., moved to or beyond) the discontinuity position. In the illustrated example, if the output of the absolute position counter 240 is greater than or equal to the value stored in the discontinuity position register 245, thereby indicating that the printer carriage 105 has moved to or beyond the discontinuity position 114, the output of the location comparator 250 is asserted. The output of the location comparator 250 is the timing adjustment trigger signal 190 and, when asserted, causes the programmable delay unit 155 to apply the timing adjustment programmed by the position calibration unit 165 to the firing pulse signals 158 feeding the printheads 150.

In some examples, the programmable delay unit 155 applies a base timing delay to each firing pulse. To apply a timing adjustment corresponding to a timing delay, the programmable delay unit 155 increases the base delay by the timing delay to be applied. Conversely, to apply a timing adjustment corresponding to a timing advance, the programmable delay unit 155 decreases the base delay by the timing advance.

Application of the timing adjustment determined and programmed by the position calibration unit 165 to the firing pulse signals 158 is further illustrated by the signal diagrams 300 of FIG. 3. For example, FIG. 3 illustrates an example firing pulse signal 158 for which timing has been adjusted by the programmable delay unit 155 using the timing adjustment 315 determined by the position calibration unit 165. Comparing the timing adjusted firing pulse signal 158 to the unadjusted interpolation signal 142, it is readily apparent that application of the timing adjustment according to the methods, apparatus and articles of manufacture described herein significantly reduces, if not substantially eliminates, the timing error in each printhead firing pulse triggered in and beyond the discontinuity region 114 of the concatenated encoder strips 113 where the spacing between the adjacent encoder strip markers 120-122 deviates from the expected spacing. For comparison, FIG. 3 also illustrates an example prior art firing pulse signal 320 in which timing errors are smoothed in a region 325 near the discontinuity between the concatenated encoder strips 110, 112. However, as mentioned above, such smoothing leaves a residual timing error 330 in the firing pulses triggered beyond the discontinuity.

Figure 4:
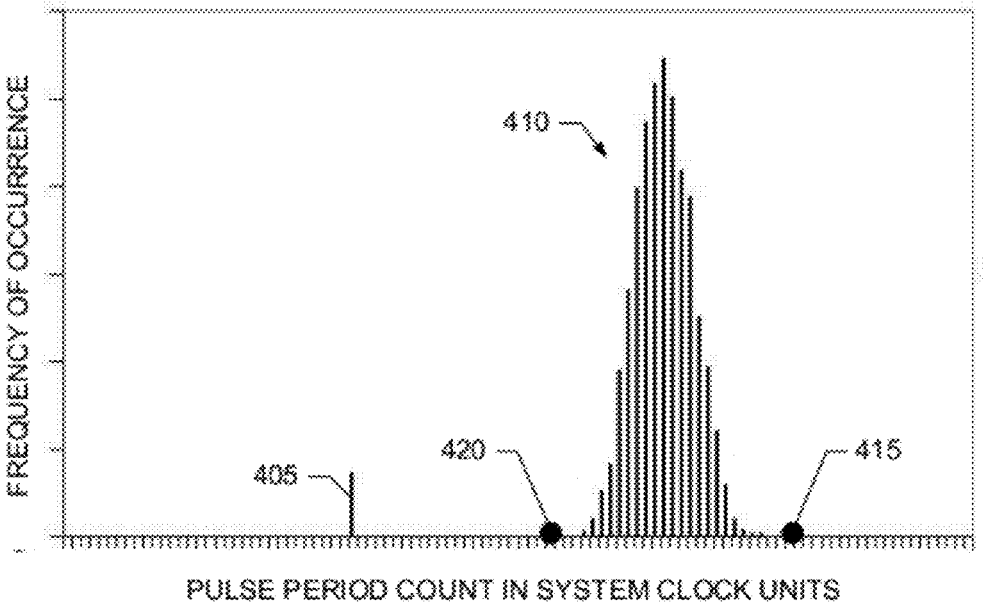
FIG. 4 is a graph illustrating a timing deviation caused by concatenating multiple encoder strips.

Example operation of the position calibration unit 165 to detect a particular pulse period 405 that deviates outside an allowed range of pulse periods 410 defined by an upper limit 415 and a lower limit 420 is further illustrated in FIG. 4. FIG. 4 illustrates an example histogram of pulse periods output by the period counter 205 during an example calibration procedure. Most of the pulse periods lie in the allowed range 410 defined by the upper limit 415 and the lower limit 420. The pulse periods lying in the allowed range 410 are concentrated near the expected pulse period, with the slight deviation within the allowed range 410 caused primarily by jitter of the printer carriage 105 as it moves along the concatenated encoder strips 113 at the known calibration speed.

FIG. 4 also depicts a pulse period 405 output by the period counter 205 that deviates outside the allowed range of pulse periods 410 defined by an upper limit 415 and a lower limit 420. The position calibration unit 165 will detect that the pulse period 405 lies outside the allowed range of pulse periods 410 (and, in particular, is less than the lower limit 420), and assert the latch signal 180 to indicate that the pulse period 405 corresponds to the location 114 where the encoder strips 110, 112 (e.g., where a deviation in adjacent marker spacing occurs).

In some examples, a test procedure is performed in which a histogram, such as the histogram illustrated in FIG. 4, is determined by capturing pulse periods output by the period counter 205 while a calibration procedure is performed. The histogram is then evaluated (e.g., manually or automatically via post-processing) to determine the upper limit 415 and the lower limit 420 bounding most (or some specified percentage) of the captured pulse periods. The determined upper and lower limits 415, 420 are then programmed into the respective upper and lower specification limit registers 210, 215. Additionally or alternatively, appropriate values for the upper and lower limits 415, 420 may be known from design parameters of the printer carriage 105.

By way of further illustration, an example test procedure in which the calibration speed of the printer carriage 105 is twenty (20) inches per second (ips) could yield an upper limit 415 corresponding to a pulse period of approximately 340 microseconds (μs), and a lower limit 420 corresponding to a pulse period of approximately 328 μs. Assuming these parameters in the illustrated example of FIG. 4, the pulse period 405 corresponds to a value of approximately 316 μs.

Although the preceding examples have been described in the context of two encoder strips 110 and 112 being concatenated to form a longer encoder strip 113, the example methods, apparatus and articles of manufacture described herein are not so limited. Instead, the method and apparatus described herein can reduce printhead firing error caused by concatenating any number of encoder strips. For example, and with reference to FIG. 2, the printer carriage 105 can be modified to include multiple discontinuity position registers 245 to store multiple discontinuity positions each associated with concatenation of two of the multiple encoder strips forming the longer concatenated encoder strip. Additionally, the position calibration unit 165 and the programmable delay unit 155 can be modified to determine and store multiple timing adjustment values, each associated with a different discontinuity position. Furthermore, the position detection unit 170 can be modified to include multiple location comparators 250 and associated timing adjustment trigger signals 190 to select which of the multiple timing adjustment values is to be applied to the firing pulse signals 158 depending upon where the printer carriage 105 is positioned relative to the different discontinuity positions stored in the multiple discontinuity position registers 245.

While an example manner of implementing the printer carriage 105 has been illustrated in FIGS. 1-2, one or more of the elements, processes and/or devices illustrated in FIGS. 1-2 may be combined, divided, re-arranged, omitted, eliminated and/or implemented in any other way. Further, the example carriage position encoder 130, the example optical sensor 135, the example quadrature decoder 140, the example firing pulse generator 145, the example programmable delay unit 155, the example position calibration unit 165, the example position detection unit 170, the example high-speed clock source 175, the example period counter 205, the example upper specification limit register 210, the example lower specification limit register 215, the example comparators 220 and 225, the example OR gate 230, the example delay computation unit 235, the example absolute position counter 240, the example discontinuity position register 245, the example location comparator 250 and/or, more generally, the example printer carriage 105 of FIGS. 1-2 may be implemented by hardware, software, firmware and/or any combination of hardware, software and/or firmware. Thus, for example, any of the example carriage position encoder 130, the example optical sensor 135, the example quadrature decoder 140, the example firing pulse generator 145, the example programmable delay unit 155, the example position calibration unit 165, the example position detection unit 170, the example high-speed clock source 175, the example period counter 205, the example upper specification limit register 210, the example lower specification limit register 215, the example comparators 220 and 225, the example OR gate 230, the example delay computation unit 235, the example absolute position counter 240, the example discontinuity position register 245, the example location comparator 250 and/or, more generally, the example printer carriage 105 could be implemented by one or more circuit(s), programmable processor(s), application specific integrated circuit(s) (ASIC(s), such as the main printer pipeline ASIC 260 illustrated in FIG. 2), programmable logic device(s) (PLD(s)) and/or field programmable logic device(s) (FPLD(s)), etc. When any of the appended apparatus claims are read to cover a purely software and/or firmware implementation, at least one of the example printer carriage 105, the example carriage position encoder 130, the example optical sensor 135, the example quadrature decoder 140, the example firing pulse generator 145, the example programmable delay unit 155, the example position calibration unit 165, the example position detection unit 170, the example high-speed clock source 175, the example period counter 205, the example upper specification limit register 210, the example lower specification limit register 215, the example comparators 220 and 225, the example OR gate 230, the example delay computation unit 235, the example absolute position counter 240, the example discontinuity position register 245 and/or the example location comparator 250 are hereby expressly defined to include a tangible medium such as a memory, digital versatile disk (DVD), compact disk (CD), etc., storing such software and/or firmware. Further still, the example printer carriage 105 of FIGS. 1-2 may include one or more elements, processes and/or devices in addition to, or instead of, those illustrated in FIG. 1-2, and/or may include more than one of any or all of the illustrated elements, processes and devices.

Figure 5:
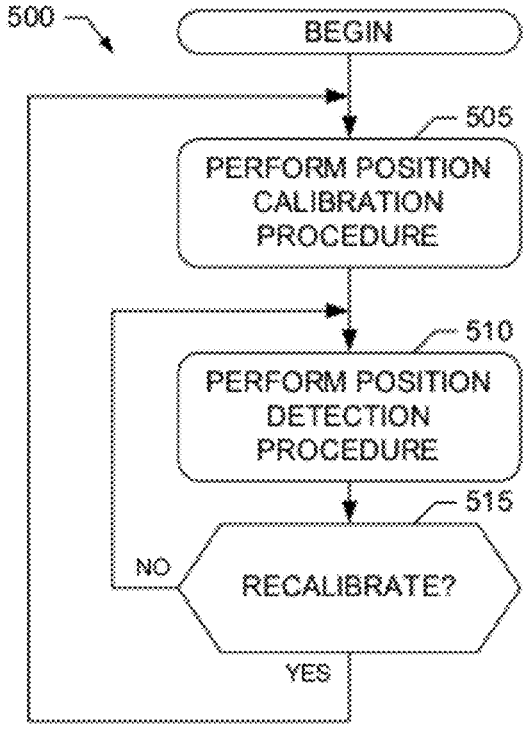
FIG. 5 is a flowchart representative of example machine readable instructions that may be executed to reduce printhead firing error in the printer carriage of FIGS. 1 and/or 2 caused by concatenating multiple encoder strips.
Figure 7:
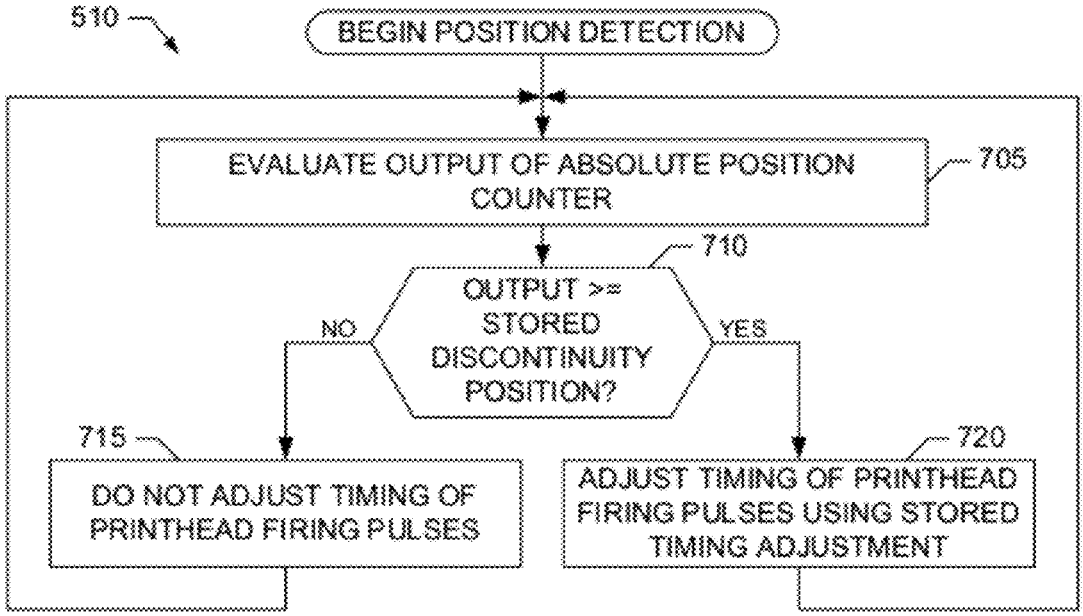
FIG. 7 is a flowchart representative of example machine readable instructions for performing discontinuity position detection that may be executed to implement the printer carriage of FIGS. 1 and/or 2.
Figure 6:
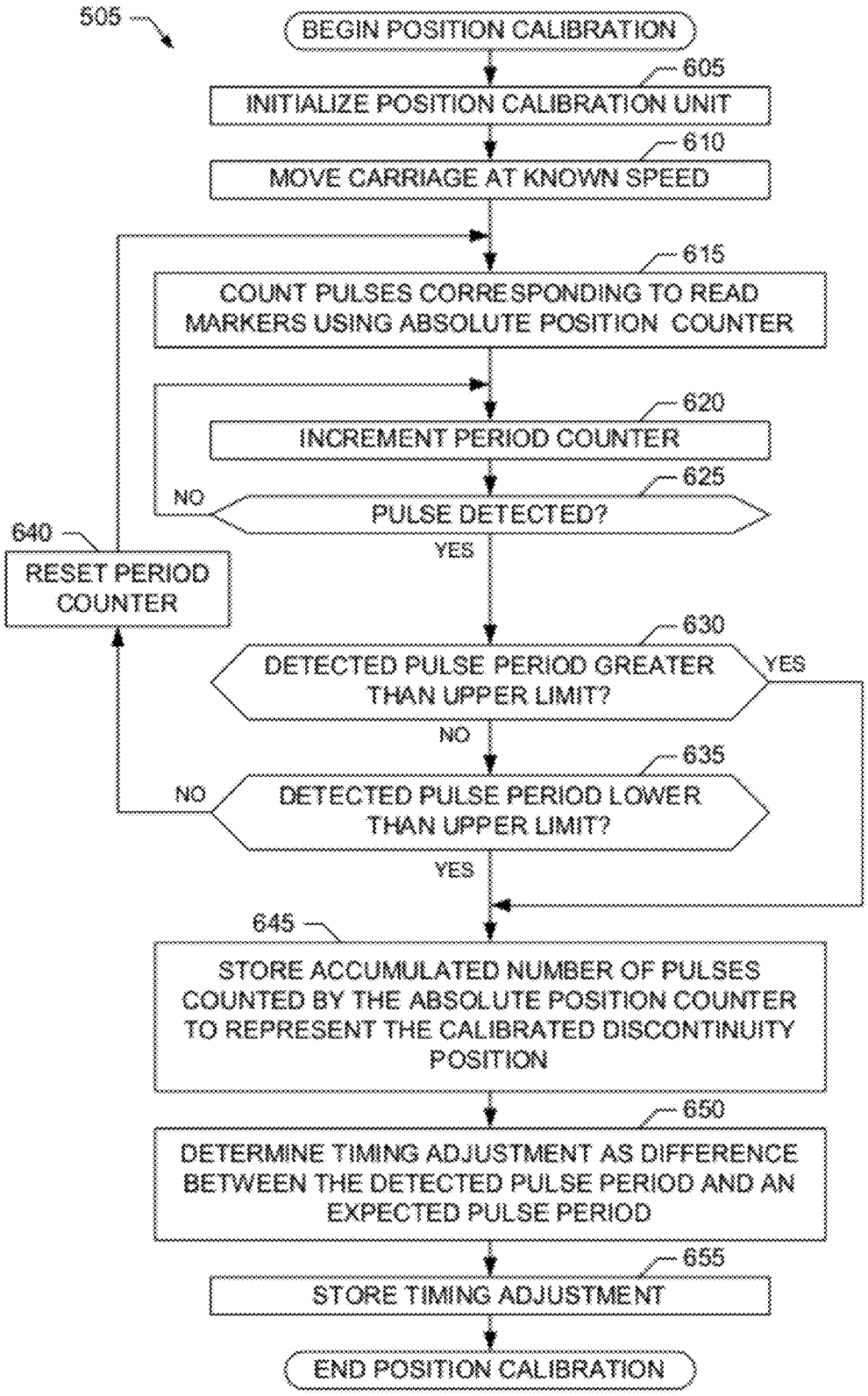
FIG. 6 is a flowchart representative of example machine readable instructions for performing discontinuity position calibration that may be executed to implement the printer carriage of FIGS. 1 and/or 2.

Flowcharts representative of example machine readable instructions that may be executed to implement the example printer carriage 105, the example carriage position encoder 130, the example optical sensor 135, the example quadrature decoder 140, the example firing pulse generator 145, the example programmable delay unit 155, the example position calibration unit 165, the example position detection unit 170, the example high-speed clock source 175, the example period counter 205, the example upper specification limit register 210, the example lower specification limit register 215, the example comparators 220 and 225, the example OR gate 230, the example delay computation unit 235, the example absolute position counter 240, the example discontinuity position register 245 and/or the example location comparator 250 are shown in FIGS. 5-7. In these examples, the machine readable instructions represented by each flowchart may comprise one or more programs for execution by: (a) a processor, such as the processor 812 shown in the example processing system 800 discussed below in connection with FIG. 8, (b) a controller, and/or (c) any other suitable device. The one or more programs may be embodied in software stored on a tangible medium such as, for example, a flash memory, a CD-ROM, a floppy disk, a hard drive, a DVD, or a memory associated with the processor 812. As used herein, the term tangible machine readable medium (or tangible computer readable medium) is expressly defined to include any type of machine (e.g., computer) readable storage and to exclude propagating signals. Additionally or alternatively, the example processes of FIGS. 5-7 may be implemented using coded instructions (e.g., computer readable instructions) stored on a non-transitory machine (e.g., computer) readable medium, such as a flash memory, a read-only memory (ROM), a random-access memory (RAM), a cache, or any other storage media in which information is stored for any duration (e.g., for extended time periods, permanently, brief instances, for temporarily buffering, and/or for caching of the information). As used herein, the term non-transitory machine readable medium (or non-transitory computer readable medium) is expressly defined to include any type of machine (e.g., computer) readable medium and to exclude propagating signals.

Alternatively, the entire program or programs and/or portions thereof implementing one or more of the processes represented by the flowcharts of FIGS. 5-7 could be executed by a device other than the processor 812 and/or embodied in firmware or dedicated hardware (e.g., implemented by an ASIC, a PLD, an FPLD, discrete logic, etc.). Also, some or all of the machine readable instructions represented by the flowchart of FIGS. 5-7 may be implemented manually. Further, although the example machine readable instructions are described with reference to the flowcharts illustrated in FIGS. 5-7, many other techniques for implementing the example methods, apparatus and articles of manufacture described herein may alternatively be used. For example, with reference to the flowcharts illustrated in FIGS. 5-7, the order of execution of the blocks may be changed, and/or some of the blocks described may be changed, eliminated, combined and/or subdivided into multiple blocks.

Example machine readable instructions 500 that may be executed to implement the printer carriage 105 of FIGS. 1-2 are represented by the flowchart shown in FIG. 5. With reference to FIGS. 1-2, the machine readable instructions 500 begin execution at block 505 of FIG. 5 at which the printer carriage 105 performs a position calibration procedure to determine a discontinuity position corresponding to the location where the encoder strips 110, 112 are concatenated (i.e., where a deviation in adjacent marker spacing occurs in the concatenated encoder strips 113). Example machine readable instructions that may be used to implement the processing at block 505 are illustrated in FIG. 6 and described in greater detail below.

After the position calibration procedure at block 505 completes, the printer carriage 105 performs a position detection procedure at block 510 during subsequent (e.g., normal) operation. At block 510, the printer carriage 105 determines whether its position has reached (e.g., has moved to or beyond) the discontinuity position 114 determined at block 505 and, if so, applies a timing adjustment to each firing pulse triggered after the printer carriage 105 has moved to or beyond the discontinuity position 114. Example machine readable instructions that may be used to implement the processing at block 510 are illustrated in FIG. 7 and described in greater detail below.

At block 515, the printer carriage 105 determines whether it is to recalibrate the discontinuity position corresponding to the location where the encoder strips 110,112 are concatenated. For example, recalibration may be appropriate when the concatenated encoder strips 113 are replaced or repaired. Such recalibration may be triggered manually (e.g., such as by a user entering an appropriate configuration input by, for example, pressing one or more input keys of a printer containing the printer carriage 105) and/or automatically (e.g., such as when the printer carriage 105 detects that the concatenated encoder strips 113 have been replaced, a power cycle event has occurred, etc.). If recalibration is to be performed (block 515), the printer carriage 105 performs the position calibration procedure at block 505. Otherwise, the printer carriage 105 continues to perform the position detection procedure at block 510.

Example machine readable instructions 505 that may be executed to implement the position calibration procedure at block 505 of FIG. 5 are illustrated in FIG. 6. With reference to the printer carriage 105 illustrated in FIGS. 1-2, execution of the machine readable instructions 505 of FIG. 6 begins at block 605 at which the position calibration unit 165 is initialized. For example, at block 605 the period counter 205 is reset and the upper and lower specification limit registers 210 and 215 are programmed with the respective upper and lower limits of the allowed range of pulse periods. Then, at block 610 the printer carriage 105 begins moving along the concatenated encoder strips 113 at the known calibration speed.

As the printer carriage 105 moves along the concatenated encoder strips 113 at the known calibration speed, the absolute position counter 240 counts pulses in the interpolated signal 142 output by the quadrature decoder 140 to track the position of the printer carriage 105 (block 615). Additionally, at block 620 the period counter 205 increments each time a clock pulse from the high speed clock 175 is detected to thereby determine a pulse period for adjacent pulses in the interpolated signal 142. When a subsequent pulse in the interpolated signal 142 is detected (block 625), the period counter 205 latches its output to store the pulse period for the most recent pair of adjacent pulses in the interpolated signal 142. The position calibration unit 165 then determines whether this pulse period deviates outside the allowed range of pulse periods initialized at block 605. For example, at block 630 the latched output of the period counter 205 is compared to the upper limit stored in the upper specification limit register 210 using the comparator 220. Similarly, at block 635 the latched output of the period counter 205 is compared to the lower limit stored in the lower specification limit register 215 using the comparator 225. If the latched output of the period counter 205 is within the upper and lower limits, the period counter 205 is reset at block 640 and pulse counting continues.

However, if the latched output of the period counter 205 deviates outside the upper and lower limits (e.g., is above the upper limit or below the lower limit), at block 645 the latch signal 180 is asserted (e.g., because one of the inputs of the OR gate 230 is asserted). Assertion of the latch signal 180 causes the output of the absolute position counter 240, which corresponds to an accumulated number of pulses in the interpolated signal 142 that have been counted so far by the absolute position counter 240, to be latched (e.g., stored) in the discontinuity position register 245. As described above, this latched output of the absolute position counter 240 represents the discontinuity position 114 at which pulse period deviation was detected.

Additionally, at block 650 the delay computation unit 235 determines the timing adjustment to compensate for the particular timing error caused by the pulse period deviation occurring at the discontinuity position 114. For example, at block 650 the delay computation unit 235 determines a timing delay or a timing advance to be applied to each firing pulse triggered when the printer carriage 105 has moved to or beyond the discontinuity position stored at block 645. As described above, the delay computation unit 235 determines the timing delay/advance based on the difference between the current (e.g., deviated) pulse period detected at block 625 and an expected pulse period for adjacent pulses in the interpolated signal 142. The delay computation unit 235 then stores the determined timing adjustment at block 650, and execution of the machine readable instructions 505 ends.

Example machine readable instructions 510 that may be executed to implement the position detection procedure at block 510 of FIG. 5 are illustrated in FIG. 7. With reference to the printer carriage 105 illustrated in FIGS. 1-2, execution of the machine readable instructions 510 of FIG. 7 begins at block 705 at which the output of the absolute position counter 240 is evaluated and compared to the value of the discontinuity position register 245 using the location comparator 250. If the output of the absolute position counter 240 is less than the value of the discontinuity position register 245 (block 710), the printer carriage 105 has not reached (e.g., has not moved to or beyond) the discontinuity position represented by the discontinuity position register 245. Accordingly, at block 715 the programmable delay unit 155 does not further adjust the timing of the firing pulses, and processing returns to block 705.

However, if the output of the absolute position counter 240 is greater than or equal to the value of the discontinuity position register 245 (block 710), the printer carriage 105 has reached (e.g., has moved to or beyond) the discontinuity position 114 represented by the discontinuity position register 245. Accordingly, at block 720 the programmable delay unit 155 applies the timing adjustment determined during position calibration (e.g., performed at block 505 of FIG. 5) to each firing pulse triggered while the absolute position counter 240 is greater than or equal to the value of the discontinuity position register 245 (e.g., while the position of the printer carriage 105 is at or beyond the discontinuity position).

Figure 8:
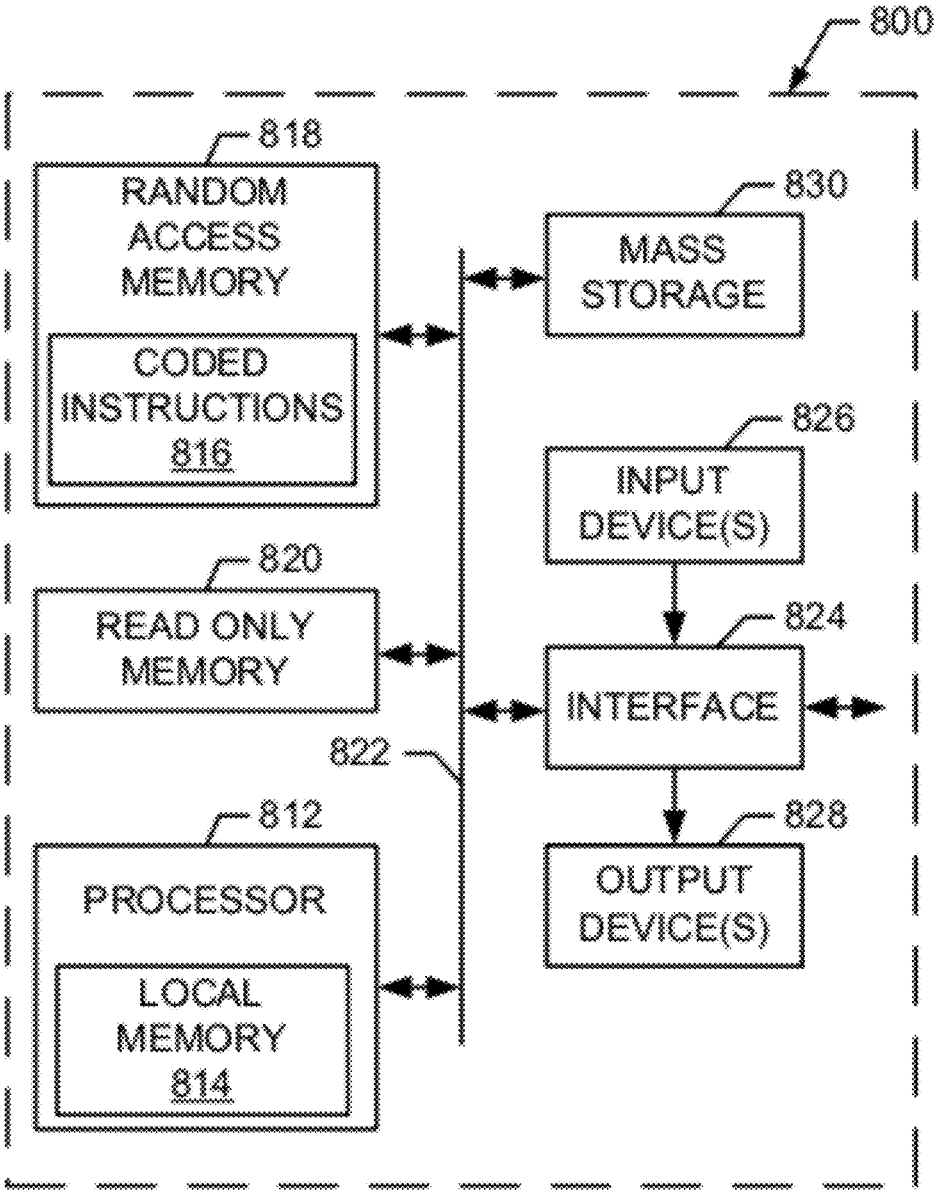
FIG. 8 is a block diagram of an example processing system that may execute the machine readable instructions of FIGS. 5-7 to implement the printer carriage of FIGS. 1 and/or 2.

FIG. 8 is a block diagram of an example processing system 800 capable of implementing the methods, apparatus and articles of manufacture disclosed herein. The system 800 of the instant example includes a processor 812 such as a general purpose programmable processor. The processor 812 includes a local memory 814, and executes coded instructions 816 present in the local memory 814 and/or in another memory device. The processor 812 may execute, among other things, the machine readable instructions represented in FIGS. 5-7. The processor 812 may be any type of processing unit, such as one or more microprocessors from the Intel® Centrino® family of microprocessors, the Intel® Pentium® family of microprocessors, the Intel® Itanium® family of microprocessors, and/or the Intel XScale® family of processors, one or more microcontrollers from the ARM® family of microcontrollers, the PIC® family of microcontrollers, etc. Of course, other processors from other families are also appropriate.

The processor 812 is in communication with a main memory including a volatile memory 818 and a non-volatile memory 820 via a bus 822. The volatile memory 818 may be implemented by Static Random Access Memory (SRAM), Synchronous Dynamic Random Access Memory (SDRAM), Dynamic Random Access Memory (DRAM), RAMBUS Dynamic Random Access Memory (RDRAM) and/or any other type of random access memory device. The non-volatile memory 820 may be implemented by flash memory and/or any other desired type of memory device. Access to the main memory 818, 820 is typically controlled by a memory controller (not shown).

The processing system 800 also includes an interface circuit 824. The interface circuit 824 may be implemented by any type of interface standard, such as an Ethernet interface, a universal serial bus (USB), and/or a third generation input/output (3GIO) interface.

One or more input devices 826 are connected to the interface circuit 824. The input device(s) 826 permit a user to enter data and commands into the processor 812. The input device (s) can be implemented by, for example, a keyboard, a mouse, a touchscreen, a track-pad, a trackball, an isopoint and/or a voice recognition system.

One or more output devices 828 are also connected to the interface circuit 824. The output devices 828 can be implemented, for example, by display devices (e.g., a liquid crystal display, a cathode ray tube display (CRT)), by a printer and/or by speakers. The interface circuit 824, thus, typically includes a graphics driver card.

The interface circuit 824 also includes a communication device such as a modem or network interface card to facilitate exchange of data with external computers via a network (e.g., an Ethernet connection, a digital subscriber line (DSL), a telephone line, coaxial cable, a cellular telephone system, etc.).

The processing system 800 also includes one or more mass storage devices 830 for storing software and data. Examples of such mass storage devices 830 include floppy disk drives, hard drive disks, compact disk drives and digital versatile disk (DVD) drives. The mass storage device 830 may implement the example upper specification limit register 210, the example lower specification limit register 215 and/or the example discontinuity position register 245. Alternatively, the volatile memory 818 may implement the example upper specification limit register 210, the example lower specification limit register 215 and/or the example discontinuity position register 245.

As an alternative to implementing the methods, apparatus and/or articles of manufacture described herein in a system such as the processing system of FIG. 8, the methods, apparatus and/or articles of manufacture described herein may be embedded in a structure such as a processor and/or an ASIC (application specific integrated circuit).

Although the above discloses example methods, apparatus and articles of manufacture including, among other components, software executed on hardware, it should be noted that such methods, apparatus and articles of manufacture are merely illustrative and should not be considered as limiting. For example, it is contemplated that any or all of these hardware and software components could be implemented exclusively in hardware, exclusively in software, exclusively in firmware, or in any combination of hardware, software, and/or firmware. Accordingly, while the following describes example methods, apparatus and articles of manufacture, the examples provided are not the only way to implement such methods, apparatus and articles of manufacture.

Finally, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A printhead firing method comprising:

determining a position of a printer carriage corresponding to a location at which a first encoder strip is concatenated with a second encoder strip; and adjusting timing of printhead firing pulses when the printer carriage is determined to have reached the position as the printer carriage is moved.

2. A method as defined in claim 1 wherein determining the position comprises processing a signal corresponding to an output of a carriage position encoder.

3. A method as defined in claim 1 wherein determining the position comprises:

moving the printer carriage at a known speed along the concatenated first and second encoder strips;

detecting a first pulse period that deviates outside an allowed range of pulse periods defined by an upper limit and a lower limit in a signal produced as the printer carriage moves at the known speed; and associating the first pulse period with the position.

4. A method as defined in claim 3 further comprising:

counting pulses in the signal; and using a number of pulses having been counted upon detection of the first pulse period to represent the position.

5. A method as defined in claim 3 wherein each of the first and second encoder strips contain a respective plurality of markers spaced apart with substantially equal spacing between each pair of adjacent markers, the signal is to contain a sequence of pulses corresponding to the markers, the first pulse period occurs between a first pulse corresponding to a first marker in the first encoder strip and a second pulse corresponding to a second marker in the second encoder strip, the first and second markers being positioned on opposite sides of the location at which the first encoder strip is concatenated with the second encoder strip, and the first and second markers have a spacing deviating from the substantially equal spacing.

6. A method as defined in claim 3 further comprising determining a timing adjustment for adjusting timing of the printhead firing pulses based on a difference between the first pulse period and an expected pulse period.

7. A method as defined in claim 3 wherein at least one of the upper limit or the lower limit is adjustable.

8. A method as defined in claim 1 wherein adjusting timing of the printhead firing pulses comprises applying a same timing adjustment to each firing pulse triggered while the printer carriage is determined to have moved to or beyond the position.

9. A method as defined in claim 8 wherein the timing adjustment is at least one of a timing delay or a timing advance.

10. A method as defined in claim 1 wherein the position is a first position, and the method further comprises using a number of pulses occurring in a signal as the printer carriage is moved from a starting position to the first position to represent the first position, the signal corresponding to an output of a carriage position encoder included in the printer carriage and positioned to read the concatenated first and second encoder strips.

11. A tangible article of manufacture storing machine readable instructions which, when executed, cause a machine to:

determine a position of a printer carriage corresponding to a location at which a first encoder strip is concatenated with a second encoder strip; and adjust timing of printhead firing pulses when the printer carriage is determined to have reached the position as the printer carriage is moved.

12. A tangible article of manufacture as defined in claim 11 wherein the machine readable instructions, when executed, further cause the machine to:

move the printer carriage at a known speed along the concatenated first and second encoder strips;

detect a first pulse period that deviates outside an allowed range of pulse periods defined by an upper limit and a lower limit in a signal corresponding to an output of a carriage position encoder included in the printer carriage and positioned to read a plurality of markers included in the concatenated first and second encoder strips, adjacent markers in the plurality of markers having substantially equal spacing except for a pair of markers spanning the location at which the first encoder strip is concatenated with the second encoder strip, the signal to include a sequence of pulses corresponding to the markers read by the carriage position encoder as the printer carriage moves at the known speed; and associate the first pulse period with the position.

13. A tangible article of manufacture as defined in claim 12 wherein the machine readable instructions, when executed, further cause the machine to determine a timing adjustment for adjusting timing of the printhead firing pulses based on a difference between the first pulse period and an expected pulse period.

14. A tangible article of manufacture as defined in claim 11 wherein the machine readable instructions, when executed, further cause the machine to adjust timing of the printhead firing pulses by applying at least one of a timing delay or a timing advance to each firing pulse triggered while the printer carriage is determined to have moved to or beyond the position.

15. A tangible article of manufacture as defined in claim 11 wherein the position is a first position, and wherein the machine readable instructions, when executed, further cause the machine to use a number of pulses occurring in a signal as the printer carriage is moved from a starting position to the first position to represent the first position, the signal corresponding to an output of a carriage position encoder included in the printer carriage and positioned to read the concatenated first and second encoder strips.

16. A printer controller comprising:

a position detection unit to:

detect whether a printer carriage has moved to or beyond a position corresponding to a location at which a spacing between adjacent markers included in concatenated first and second encoder strips deviates from an expected spacing; and cause timing of printhead firing pulses to be adjusted when the printer carriage is detected to have moved to or beyond the position as the printer carriage is moved.

17. A printer controller as defined in claim 16 further comprising a position calibration unit to:

count pulses in a signal corresponding to an output of a carriage position encoder, the pulses corresponding to markers included in the concatenated first and second encoder strips that are read by the carriage position encoder as the printer carriage moves;

detect a first pulse period in the signal that deviates outside an allowed range of pulse periods defined by an upper limit and a lower limit; and use a number of pulses having been counted upon detection of the first pulse period to represent the position.

18. An apparatus as defined in claim 17 wherein the position calibration unit is to determine a timing adjustment to adjust timing of the printhead firing pulses based on a difference between the first pulse period and an expected pulse period.

19. An apparatus as defined in claim 16 wherein the position detection unit is to count pulses in a signal corresponding to an output of a carriage position encoder included in the printer carriage and positioned to read the markers as the printer carriage moves to detect whether the printer carriage has moved to or beyond the position.

20. An apparatus as defined in claim 16 wherein the position detection unit is to cause at least one of a timing delay or a timing advance to be applied to each firing pulse triggered while the printer carriage is detected to have moved to or beyond the position.

* * * * *